United States Patent [19]

Morse

[11] 4,318,069

[45] Mar. 2, 1982

[54] BOBBIN WITH TERMINAL BLOCK DESIGNED FOR MACHINE WRAP

[75] Inventor: John B. Morse, Boston, Mass.

[73] Assignee: Polaroid Corporation, Cambridge, Mass.

[21] Appl. No.: 96,614

[22] Filed: Nov. 23, 1979

[51] Int. Cl.[3] ..... H01F 15/10

[52] U.S. Cl. ..... 336/192; 336/198; 337/255

[58] Field of Search ..... 336/192, 198, 208; 337/255

[56] References Cited

U.S. PATENT DOCUMENTS

| | | | |
|---|---|---|---|
| 1,805,638 | 5/1931 | Scofield et al. . | |
| 2,649,558 | 8/1953 | Franz . | |
| 3,076,165 | 1/1963 | Weyrich | 339/17 |
| 3,189,772 | 6/1965 | Wingler et al. | 336/198 X |
| 3,189,857 | 6/1965 | Jones | 336/198 |
| 3,230,489 | 1/1966 | Weyrich | 336/192 |
| 3,265,999 | 8/1966 | Kessel | 336/192 |
| 3,445,797 | 5/1969 | Otto | 336/192 |
| 3,453,575 | 7/1969 | Davis | 336/192 |
| 3,555,477 | 1/1971 | Hildebrandt | 336/192 |
| 3,731,245 | 5/1973 | Roslin | 336/192 |
| 3,848,208 | 11/1974 | Dawson et al. | 336/192 X |
| 4,023,262 | 5/1977 | Miknaitis | 29/605 |
| 4,086,553 | 4/1978 | Robandt et al. | 336/192 |
| 4,122,424 | 10/1978 | Plunkett | 336/192 X |

FOREIGN PATENT DOCUMENTS

| | | | |
|---|---|---|---|
| 2341769 | 3/1975 | Fed. Rep. of Germany | 336/192 |

*Primary Examiner*—Robert J. Hickey
*Attorney, Agent, or Firm*—Edward S. Roman

[57] ABSTRACT

An electric solenoid having a bobbin structure on which a coil may be wound by machine and providing a plug-in connector with leaf-like contact terminals to which at least one end of the coil wire may be electrically connected by machine wrapping of the wire end about the terminals. The bobbin has a spool portion and a terminal block portion having a projecting formation to be positioned adjacent to the terminals, so that wire extending from the coil under tension may be wrapped first about the formation and then about the terminal to be wrapped to secure the terminal to the formation prior to subsequent wraps of the wire around the terminal.

13 Claims, 7 Drawing Figures

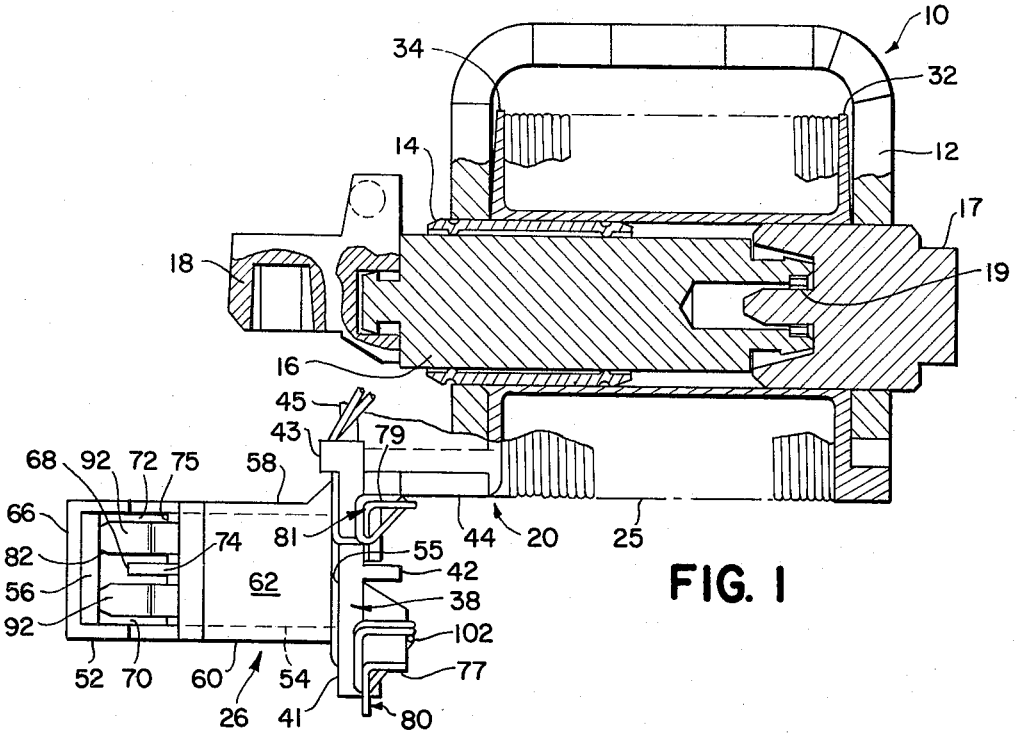
FIG. 1
FIG. 2
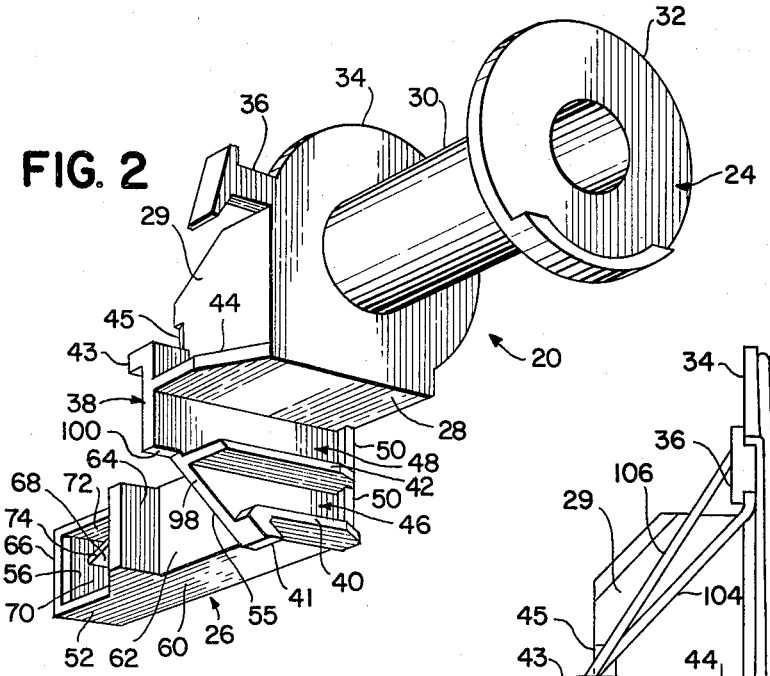
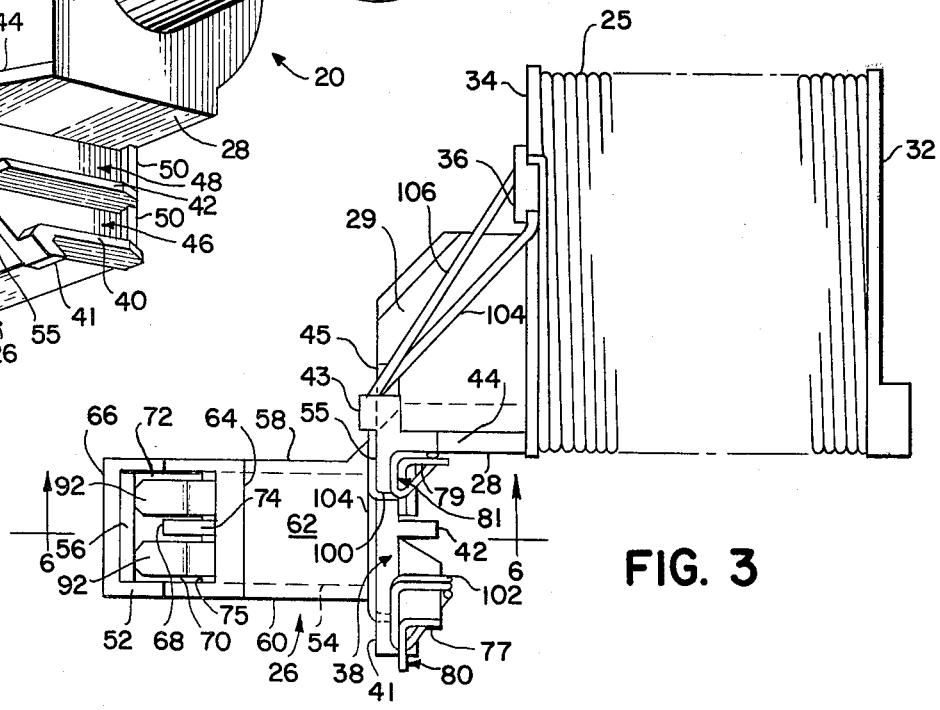
FIG. 3

BOBBIN WITH TERMINAL BLOCK DESIGNED FOR MACHINE WRAP

BACKGROUND OF THE INVENTION

This invention relates to electromagnetic coils or solenoids and, more particularly, it concerns a bobbin structure which may be machine-wound to provide a solenoid with coupling terminals for releasable mechanical connection to an electric circuit.

Machine-wound solenoids typically include a bobbin having a hollow cylindrical mandrel extending between a pair of annular flanges, and a pair of electrical terminal posts located in the plane of one of the flanges. The bobbin is wound with wire to form an electrical coil from which the wire extends as leads to be wrapped around each of the terminals. Machine wrapping of one or both of the wire leads on the electrical terminal posts has, in general, required that the terminal posts be located in the plane of one of the flanges so that tension may be maintained in the wire as the lead is wrapped around the terminal. Otherwise, the final revolutions of wire on the coil will be loose and may become tangled or unravelled. Also, the terminal posts are generally formed of relatively heavy or bar-like conductive metal to lend rigidity and strength adequate to withstand the forces imposed by winding the wire leads under tension as well as to facilitate a soldered connection of power circuit leads to the post and thus to the coil.

In many applications of small machine-wound solenoids, such as for actuation of electronic shutters in photographic cameras, constraints imposed by such factors as the size and configuration of space available to receive the solenoid, facility for cost-effective assembly procedures and the like, present problems to the use of machine-wound solenoids of the type aforementioned. For example, the terminal posts, in projecting beyond the periphery of the coil, represent an added space requirement both in themselves and in the accommodation of power circuit lead connections to the posts. With respect to assembly procedures, it is often desirable from the standpoint of cost effectiveness to assemble the solenoid with the mechanical components to be operated thereby prior to completing the electrical connection of circuit leads with the terminal posts. The subsequent connection of power circuit leads to the preassembled solenoid, however, is most effectively and reliably accomplished by a plug-in type connector which is not readily accommodated by the design configuration of conventional machine-wound solenoids.

SUMMARY OF THE INVENTION

In accordance with the present invention, a bobbin structure is provided by which one side of a plug-in connector is incorporated in a solenoid, the coil of which is capable of being wound and the wire windings thereof terminated as a plurality of wraps about one of two leaf-like connector terminals preassembled with the bobbin. The bobbin is a one-piece molding of non-conductive synthetic resinous material having a flanged spool portion and a terminal block portion projecting from one of the spool flanges in a radially offset position relative to the winding axis of the spool. As a result of this configuration, the actuating end of a plunger in the completed solenoid may be made accessible on the same end of the coil as the terminal block.

The terminal block portion of the bobbin is shaped in a manner to enable prestamped and bent leaf-like contact terminals to be inserted in place with a single direction of inserting movement. The legs of the contact terminals about which the coil wire leads are wrapped extend from the block to be presented in offset spaced relationship along one surface of the block. Because of the relatively flexible nature of the base portions of the legs of the contact terminals which are initially supported in only one direction, the terminal block is provided with projecting formations about which an initial wrap of wire extending under tension from the wound coil serves to anchor the contact terminal to the terminal block in a manner so that successive wrappings of the coil wire lead may be made without excessive deflection of the leaf-like terminal leg portion. The offset relationship of the terminal leg portions enables at least one of them to be wound by machine without interference from the other.

Among the objects of the present invention are, therefore, the provision of an improved bobbin structure by which a plug-in power circuit connector may be integrated with a machine-wound solenoid coil; the provision of such a bobbin structure which facilitates the use of leaf-like resilient contact terminals; the provision of such a bobbin structure which enables space accommodating orientation of a solenoid power circuit connection; and the provision of an improved machine-wound solenoid.

Other objects and further scope of applicability of the present invention will become apparent from the detailed description to follow taken in conjunction with the accompanying drawings in which like parts are designated by like reference numerals.

BRIEF DESCRIPTION OF THE DRAWINGS

FIG. 1 is an elevation in partial section of the electrical solenoid according to the present invention;

FIG. 2 is a perspective view of the bobbin of the electrical solenoid, in which electrical connectors mounted on the bobbin are shown in phantom lines;

FIG. 3 is an elevation of a wound bobbin assembly of the solenoid illustrated in FIG. 1;

DETAILED DESCRIPTION OF THE PREFERRED EMBODIMENT

Figure 4:
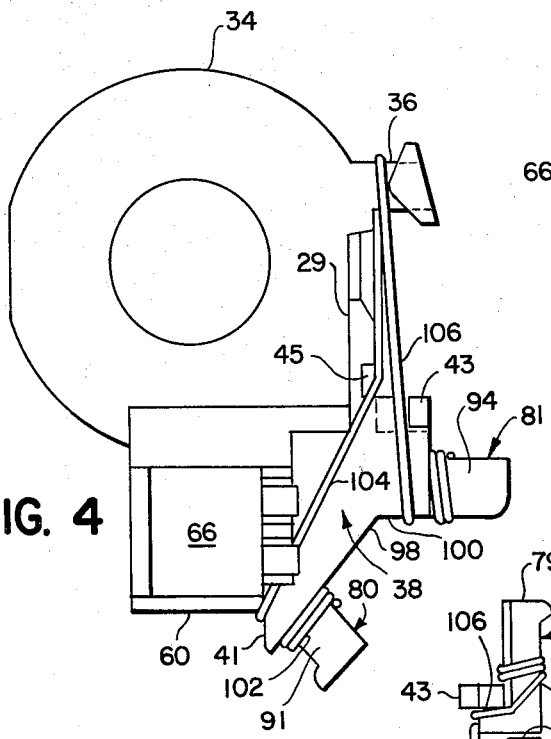
FIG. 4 is a fragmentary side elevation of the bobbin shown in FIG. 3.

In FIG. 1 of the drawings, a solenoid is designated generally by the reference numeral 10 and shown to include a frame 12, a flux guide 14, a plunger 16 slidably mounted within the flux guide, a plug 17 receiving the plunger 16 and connected to the frame 12, a yoke 18 secured to one end of the plunger 16 and adapted to connect the plunger to a device to be operated by the solenoid, and a bearing 19 positioned between the plug 17 and the end of the plunger 16 adjacent to the plug. The solenoid 10 also includes the bobbin of the present invention which is generally designated by the reference numeral 20 and most clearly shown in FIG. 2 to include a spool portion 24 about which a wire coil 25 (FIG. 1) is wound and a terminal block portion 26 integrally connected to the spool portion 24 by a pair of mutually perpendicular web portions 28, 29.

The spool portion 24 includes a hollow cylindrical coil-receiving mandrel 30 to establish the winding axis of the coil 25 and which extends between and is joined integrally with a pair of annular flanges 32 and 34. Guide means are integrally formed with the flange 34 and preferably comprise a protruding guide post 36, which extends from the flange 34 beyond the periphery of the flange 34.

The terminal block portion 26 has an irregularly-shaped planar wall portion 38 projecting perpendicularly from the end of the web portion 28 in a direction away from the axis of the mandrel 30. An inner surface 39 of the wall portion 38 facing the spool portion 24 has generally parallel rib-like formations 40, 42 and 44 formed thereon and projecting perpendicular to the plane of the wall portion 38 to define two generally parallel channels 46 and 48. The formation 44 and a part of the web portion 28 define one of the boundaries defining the channel 48. Integrally formed within each of the channels 46, 48 is a transverse anchoring rib formation 50 extending perpendicularly from the surface 39 of the wall portion 38.

The wall portion 38 includes a first integral flange or projection 41 extending laterally outward therefrom from the side of the rib 40 and a second integral flange or projection 43 extending laterally outward therefrom in a direction away from the flange 34 for reasons which will become more apparent from the following discussion. In addition, the edge of the web 29 also includes a beveled notch or recess 45 in the edge thereof parallel to the wall portion 38 for reasons which will also become more apparent from the following discussion.

The terminal block 26 also includes a receptacle portion 52 shown most clearly in FIGS. 3–6 to include a terminal-receiving formation 54 projecting from an outer surface 55 of the wall 38 and terminating in a plug-receiving opening 56. The terminal-receiving formation 54 is formed integrally with the wall portion 38 and extends perpendicularly therefrom in a direction away from the spool portion 24. As can best be seen in FIGS. 5 and 6, the terminal receiving formation includes a pair of parallel side walls 58 and 60 (FIG. 3), a transverse wall 62 bridging one edge of the side walls 58 and 60 and a partition wall 64 spaced from and parallel to the wall portion 38, the walls 38 and 64 forming opposite end walls of the terminal receiving formation 54. One side of the terminal receiving formation 54 is open and circumscribed on two sides by the edges of the side walls 58 and 60 which are flush with one edge of the web portion 28. The other two sides of the openings are bounded by edges of the wall 64 and the wall portion 38 which are slightly recessed from the edges of the side walls 58 and 60.

The side walls 58 and 60, respectively, extend beyond the partition wall 64 of the terminal receiving formation to define also, side walls of the plug receiving opening 56. An end wall 66 lies parallel to the wall 64 and integrally connects the extensions of the side walls 58 and 60. The end wall 66 is chamfered to form a narrow edge which is flush with the edges of the side walls 58 and 60.

The face of the wall 64 directed toward the second wall 66 has formed thereon a partitioning rib 68 parallel to the side walls 58 and 60 and midway between them so as to define two channels 70 and 72. The front portion of the partition 68 includes a bevel 74 which is coplanar with corresponding tapered edge portions of the side walls 58 and 60, respectively. A transverse anchoring ridge formation 75 is integrally formed within each of the channels 70 and 72, extending perpendicularly from the face of the wall 64.

Figure 7:
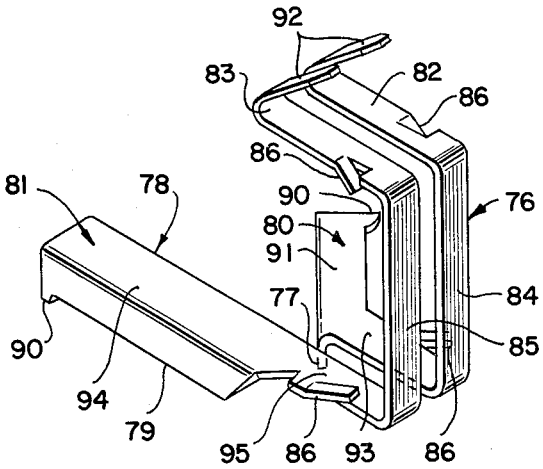
FIG. 7 is a perspective view of the electrical terminals incorporated in the solenoid.

In FIG. 7 of the drawings, two contact terminals 76 and 78 are shown to be positioned relative to each other in an orientation the same as that in which they are supported by the terminal block 26. Each of the contact terminals is the same to the extent that they are stamped or otherwise formed from thin, resilient, leaf-like conductive material to provide a generally U-shaped configuration in which lead receiving legs 80 and 81 are joined with contact legs 82 and 83 by bight portions 84 and 85, respectively. Anchoring tangs 86 are struck inwardly from both legs 80, 82 and 81, 83 of the respective contact terminals 76 and 78. Also, the lead receiving legs 80 and 81 are each formed with respective right angle stiffening fold portions 77, 79 and integral wire retaining tangs 90 at the outside ends thereof. The contact legs 82 and 83 of both terminals are bent over to form identical contact blade projections 92.

The contact terminals 76 and 78 differ from each other principally in the configuration of the lead receiving leg portions 80 and 81. Specifically, that portion of the lead receiving leg 80 of the terminal 76 which serves as a wire wrapping leg portion is shown at 91 and projects angularly from a base portion 93 which lies in parallel, coplanar relationship to the contact leg 82. That portion of the leg 81 of the terminal 78 which serves as a wire wrapping leg portion is shown generally at 94 and projects straight out from a narrow base portion 95 which lies in parallel coplanar relationship to the contact leg 83. The wire wrapping leg portion 94 of the leg 81 is positioned beyond the wire wrapping leg portion 91 of the leg 80 in a direction parallel to the base portions 93 and 95. Moreover, the wire wrapping leg portion 94 of the leg 81 is positioned beyond all of the leg 80 in a direction parallel to the base portions 93 and 95. As a result of the combined orientation and configuration of the legs 80 and 81, it will be appreciated that a wire wrapped about the leg 81 may extend from the wire wrapping leg portion 94 thereof in planes perpendicular to the leg 81 without interference from the leg 80 of the contact 76.

Figure 6:
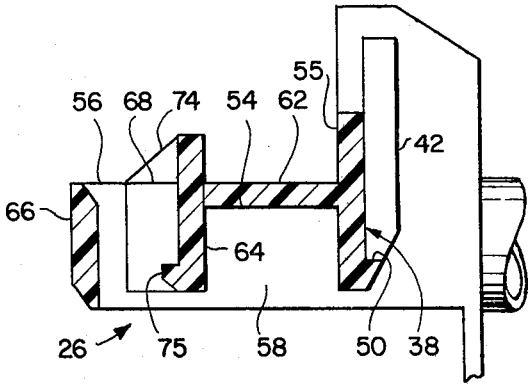
FIG. 6 is a sectional view taken along the line 6—6 of FIG. 3.

From the foregoing description of the construction of the bobbin 10, particularly the terminal block portion 26 thereof and the configuration of the contact terminals 76 and 78 with reference to FIG. 7, the assembly of the contact terminals with the terminal block will be apparent particularly from the illustrations of FIGS. 6 and 7. In the case of the contact terminal 78, the legs 81 and 83 thereof are merely aligned respectively with the channels 48 and 72 and pushed against the terminal receiving formation until the tangs 86 snap over the ribs 50 and 75. Similarly, the contact terminal 76 is snapped into place after aligning the legs 80 and 82 thereof with the channels 46 and 70. When in place, the contact blade projections 92 will be presented in the receptacle opening and the lead receiving legs 80 and 81 will project from an outer edge 98 of the wall portion 38 (FIG. 4).

As may be seen in FIGS. 2–5, the outer edge 98 of the wall portion 38 lies on a line generally parallel to and inside or toward the base portions 93 and 95 from a line intersecting the inside of the wire wrapping leg portions 91 and 94 in respective legs 80 and 81 of respective terminals 76 and 78. The orientation of the outer edge results in the channel 48, which is closer to the winding axis, being longer than the channel 46. Further, a bend is formed in the edge 98 and extends straight outward in parallel relation to the rib 42 so as to define a projecting edge portion as shown at 100 which extends outwardly of the inside edge of the wire wrapping leg portion 94 in the leg 81 of the contact terminal 78 when the latter is positioned on the terminal block portion 26.

In light of the configuration of the contact terminals 76, 78 and the formation 54 of the terminal block 26, it will be seen that, once snapped into place, the contact terminals 76 and 78 will be retained as an assembly with the bobbin 20. It will also be observed, however, that the legs 80 and 81 in such an assembly are supported on one side only by the wall portion 38 and may flex freely about the base portions 93, 95 under a force acting in a direction toward the spool flange 34, for example. Moreover, because of the thin stock material from which the contact terminals 76 and 78 are formed, the mere connection of the contact terminals to the terminal block 26 in this manner, in and of itself, is inadequate from the standpoint of supporting the wrapping legs both for complete winding of the coil 25 and in the finished solenoid 10.

Although the machine on which the bobbin 20 is wound to form the coil 25 is not shown in the drawings, it may be any one of several conventional coil winding machines by which the bobbin 20 is supported for rotation on the axis of the mandrel 30 and driven so that a wire connected to the bobbin and extending to a wire supply (not shown) under tension, will be wound into the coil 25. Specifically, such a wire is connected to the wire wrapping leg portion 91 of the leg 80 of the contact terminal 76, usually by hand wrapping, after the assembly of the bobbin and the contact terminals are supported on the wrapping machine.

As may be seen in FIGS. 3 and 4, an initial wrapping 102 is placed on the leg 80 in a direction so that a starting lead 104 departs from the wrap 102 under the projection 41 and across the outer surface 55 of the wall portion 38 to the notch 45. From the notch 45 in the edge of the surface 55, the starting lead 104 is trained about one edge (the following edge in terms of spool rotation during winding of the coil 25) of the guide post 36 and onto the mandrel 30. The wire, including the starting lead 104, is then placed in tension and maintained in that state throughout rotation of the spool 24 to wind the coil 25. It will be noted at this point that the wire wrapping leg portion 91 of the leg 80 of the terminal 76 is now pulled by the starting lead 104 snugly against the wall portion 38 due to the starting lead being wrapped across the outer surface 55 of the wall portion 38 after its connection in the wrap 102 to the leg 80.

After completely winding the coil 25, rotation of the spool 24 is terminated but without relieving tension on the wire extending from the coil. At this point, an arm (not shown) forming part of the winding machine on which the bobbin is supported, engages the taut wire extending from the completed coil 25 and also extending from the arm to a point of tension. The wire is then trained as a finishing lead 106 about the opposite edge of the guide post 36 about which the starting lead 104 was wrapped and back to the edge portion 100 of the outer edge 98 of the wall portion 38 (compare FIGS. 3 and 4). The finishing lead 106 is trained to abut the projection 43 as shown in FIG. 4 and thereby maintained in spaced apart relation with respect to the starting lead 104 across the back surface 55 of the wall portion 38. After being guided across the back surface 55 of the wall portion 38 to the edge portion 100, the wire is wrapped by machine about the wire wrapping leg portion 94 of the leg 81 of the contact terminal 78. It will be noted that because the initial portion of the finishing lead 106 about the leg 81 begins with support by the wall portion 38, specifically the projecting edge portion 100, the first winding force on the leg portion 81 will be in a direction tending to bind it against the wall portion 38. This connection of the leg 81 to the wall portion 38 enables successive finishing wraps to be wound on the leg portion 81 without separating the leg portion from the wall portion 38. In this manner, there is provided a projecting formation, i.e., wall portion 38 including edge portion 100 positioned against the wire wrapping leg portion 94 of the leg 81 so that the finishing lead 106 can be wrapped about the formation and then about the wire wrapping leg portion 94 to secure the leg 81 to the formation.

Figure 5:
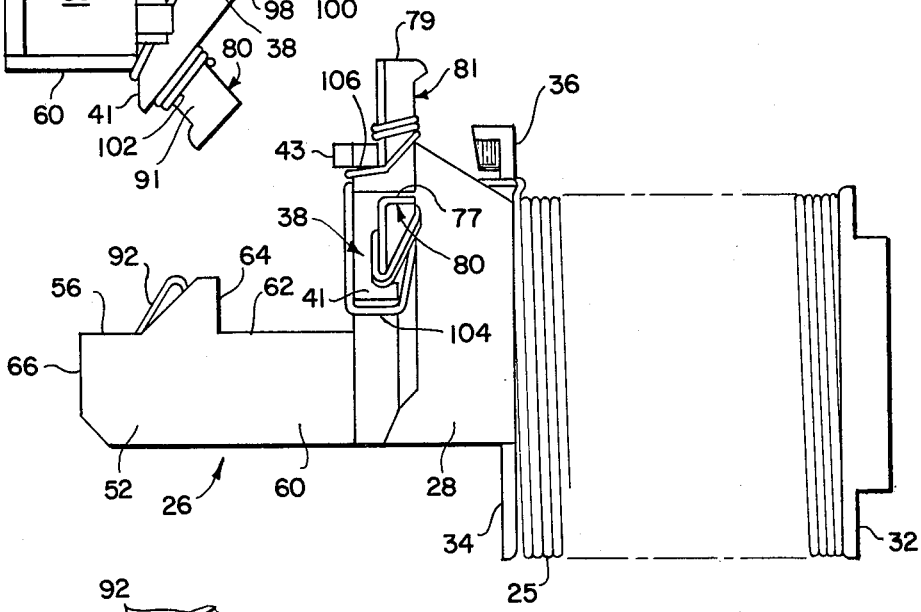
FIG. 5 is a an elevation of the bobbin at right angles to that shown in FIG. 3.

After the finishing lead 106 is wrapped about the leg 81, the wire is cut and the wound assembly of the coil and bobbin as shown in FIGS. 3–5 removed from the machine on which the coil 25 was wound. The lead wrappings of wire about the leg portions 80 and 81 are then dipped in solder to secure the lead wrappings and the terminal wrapping leg portions. In this respect, it will be noted again that the relationship of the outer edge 98 on the wall portion facilitates such a dip soldering. Perhaps more importantly, the relationship of the outer edge 98 and the projecting wire wrapping leg portions 91, 94 of legs 80 and 81, respectively, facilitates the terminal winding of the finishing lead 106 by machine and without interference from the projecting wire wrapping leg portion 91 of leg 80 on which the initial wrap 102 was formed.

The wound bobbin assembly shown in FIGS. 3–5 is then fitted with the components of the solenoid identified above with respect to FIG. 1. As will be seen by reference to FIG. 1, the resulting solenoid 10 is one in which essentially the complete coil and frame may be received in a chamber of the device incorporating the solenoid in that the solenoid may be preassembled in such fashion without loss of access either to the mechanical connecting yoke 18 or the electrical terminal block 26 because of the radially spaced orientation of the terminal block from the axis of the coil 25 and the plunger 16.

Thus, it will be seen that as a result of the present invention, a highly improved bobbin assembly is provided by which the objectives of the invention are completely fulfilled. Also, it will be apparent to those skilled in the art from the preceding description that modifications and/or changes may be made in the illustrated embodiment without departure from the invention. Accordingly, it is expressly intended that the foregoing is illustrative of a preferred embodiment only, not limiting, and that the true spirit and scope of the present invention will be determined with reference to the appended claims.

What is claimed is:

1. A bobbin for an electromagnetic device having a coil, and electrical terminals having lead receiving legs to be connected with wire leads said bobbin comprising:

a spool portion having a winding axis about which the coil is formed by winding a continuous length of wire maintained under tension, and at least one flange lying in a plane substantially perpendicular to said winding axis;

guide means connecting to said spool portion for engaging the wire extending from the coil under tension so that the wire may be extended to and wrapped around at least one of the lead receiving legs of the electrical terminals while maintained under tension; and a terminal block portion connecting to said spool portion and spaced axially apart from said flange having a planar wall portion with two substantially parallel channels formed thereon positioned parallel to the lead receiving legs of the terminals, said planar wall portion also defining a projecting formation to be positioned adjacent to the lead receiving leg of at least one of the terminals whereby wire extending from said coil under tension may be wrapped first about said formation and then about said lead receiving leg to secure said leg to said formation and its respective channel prior to subsequent wraps of the wire around said leg.

2. The apparatus recited in claim 1, wherein said planar wall portion is positioned parallel to and adjacent to the lead receiving leg of said at least one terminal.

3. The apparatus recited in claim 1, wherein said guide means extends from said one flange.

4. A bobbin for an electromagnetic device having a coil, and electrical terminals having lead receiving legs to be connected with wire leads said bobbin comprising:

a spool portion having a winding axis about which the coil is formed by winding a continuous length of wire maintained under tension, and at least one flange lying in a plane substantially perpendicular to said winding axis;

guide means connecting to said spool portion for engaging the wire extending from the coil under tension so that the wire may be extended to and wrapped around at least one of the lead receiving legs of the electrical terminals while maintained under tension; and a terminal block portion connecting to said spool portion and spaced axially apart from said flange having a planar wall portion defining a projecting formation to be positioned adjacent to the lead receiving leg of at least one of the terminals whereby wire extending from said coil under tension may be wrapped first about said formation and then about said lead receiving leg to secure said leg to said formation prior to subsequent wraps of the wire around said leg, wherein the planar wall portion has two substantially parallel channels formed thereon, said planar wall portion having an edge defining ends of the channels and disposed at an angle to the channels, whereby one channel is longer than the other channel.

5. The apparatus recited in claim 4, wherein ribs are formed in generally parallel relation with respect to each other on the planar wall portion to define the channels and a bend is formed in said edge so as to define a projecting edge portion which extends substantially straight outward in generally parallel relation to said ribs so that a portion of the planar wall portion defines said projecting formation.

6. A bobbin for an electromagnetic device having a coil, and electrical terminals having lead receiving legs to be connected with wire leads said bobbin comprising:

a spool portion having a winding axis about which the coil is formed by winding a continuous length of wire maintained under tension, and at least one flange lying in a plane substantially perpendicular to said winding axis;

guide means connecting to said spool portion for engaging the wire extending from the coil under tension so that the wire may be extended to and wrapped around at least one of the lead receiving legs of the electrical terminals while maintained under tension; and a terminal block portion connecting to said spool portion and spaced axially apart from said flange having a planar wall portion defining a projecting formation to be positioned adjacent to the lead receiving leg of at least one of the terminals whereby wire extending from said coil under tension may be wrapped first about said formation and then about said lead receiving leg to secure said leg to said formation prior to subsequent wraps of the wire around said leg, wherein said terminal block portion includes anchoring formations extending therefrom.

7. The apparatus recited in claim 4, wherein the longer channel is located closer to the winding axis than the shorter channel is located.

8. A bobbin assembly for an electromagnetic device having a coil comprising:

a spool portion having a winding axis about which the coil is formed by winding a continuous length of wire maintained under tension;

guide means connecting to said spool portion for engaging the wire extending from the coil under tension;

a terminal block portion connecting to said spool portion and having a wall portion which defines a projecting formation;

electrical terminals connected to the terminal block portion and having lead receiving legs for connecting the coil with an electrical circuit, one of the lead receiving legs being adapted to be wrapped with the wire extending from the coil under tension;

wherein said one lead receiving leg is positioned adjacent to the projecting formation, whereby wire extending from said coil under tension may be wrapped first about said formation and then about said one leg to secure said one leg to said formation prior to subsequent wraps of the wire around said one leg; and wherein two terminals are received on said terminal block portion, each terminal having a lead receiving leg having a base portion and a wrapping leg portion projecting beyond the terminal block portion, the base portions being substantially parallel and the wrapping leg portion of one terminal being parallel to the base portions and projecting beyond the wrapping leg portion of the other terminal in a direction parallel to the base portions.

9. The apparatus of claim 8, wherein said one terminal is located closer to the winding axis than said other terminal is located.

10. The apparatus of claim 8, wherein the terminal block portion has an edge lying on a line substantially parallel to and toward the base portions from a line intersecting the inside edges of the wrapping leg portions.

11. The apparatus of claim 10, wherein the wrapping leg portion of said other terminal projects angularly outward from its said base portion beyond said edge by a sufficient distance to accommodate a wire wrap and the wrapping leg portion of said one terminal is positioned beyond all of the wrapping leg portion of said other terminal.

12. The apparatus of claim 8, wherein the wrapping leg portion of said one terminal is positioned beyond all of the wrapping leg portion of said other terminal in a direction parallel to said base portions.

13. The apparatus of either claim 11 or 12, in which the wrapping leg portions of each of said terminals include a right angle stiffening fold portion.

* * * * *